US007226366B2

(12) United States Patent
Galloway

(10) Patent No.: US 7,226,366 B2
(45) Date of Patent: Jun. 5, 2007

(54) GOLF CLUB HEAD WITH GASKET

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 410 days.

(21) Appl. No.: 10/709,838

(22) Filed: Jun. 1, 2004

(65) Prior Publication Data

US 2005/0266933 A1 Dec. 1, 2005

(51) Int. Cl.
*A63B 53/04* (2006.01)

(52) U.S. Cl. ..... 473/342; 473/332; 473/345

(58) Field of Classification Search ..... 473/324–350
See application file for complete search history.

(56) References Cited

U.S. PATENT DOCUMENTS

| | | | | |
|---|---|---|---|---|
| 1,167,387 | A | | 1/1916 | Daniel |
| 1,780,625 | A | | 11/1930 | Mattern |
| 2,750,194 | A | | 6/1956 | Clark |
| 3,692,306 | A | | 9/1972 | Glover |
| 3,706,714 | A | * | 12/1972 | Lloyd et al. ..... 528/76 |
| 3,897,066 | A | | 7/1975 | Belmont |
| 3,937,474 | A | | 2/1976 | Jepson et al. |
| 3,970,236 | A | | 7/1976 | Rogers |
| 3,975,023 | A | | 8/1976 | Inamori |
| 3,989,248 | A | | 11/1976 | Campau |
| 4,398,965 | A | | 8/1983 | Campau |
| 4,568,088 | A | | 2/1986 | Kurahashi |
| 4,811,949 | A | | 3/1989 | Kobayashi |
| 4,872,685 | A | | 10/1989 | Sun |
| 4,877,249 | A | | 10/1989 | Thompson |
| 5,024,437 | A | | 6/1991 | Anderson |
| 5,094,383 | A | | 3/1992 | Anderson |
| 5,106,094 | A | | 4/1992 | Desboilles et al. |
| 5,193,811 | A | | 3/1993 | Okumoto et al. |
| 5,255,918 | A | | 10/1993 | Anderson |
| 5,261,663 | A | | 11/1993 | Anderson |
| 5,261,664 | A | | 11/1993 | Anderson |
| 5,282,624 | A | | 2/1994 | Viste |
| 5,310,185 | A | | 5/1994 | Viollaz et al. |
| 5,344,140 | A | | 9/1994 | Anderson |
| 5,344,340 | A | | 9/1994 | Bouleau |

(Continued)

FOREIGN PATENT DOCUMENTS

JP 2001145712 A * 5/2001

*Primary Examiner*—Eugene Kim
*Assistant Examiner*—Alvin A. Hunter, Jr.
(74) *Attorney, Agent, or Firm*—Michael A. Catania; Elaine H. Lo

(57) ABSTRACT

A golf club (40) having a club head (42) with a face component (60), an aft body (61) and a gasket (300) is disclosed herein. The face component (60) has a striking plate portion (72) and a return portion (74). The aft-body (61) is preferably composed of a crown portion (62), a sole portion (64) and optionally a ribbon section (90). The gasket (300) provides an interface between the face (60) and the aft-body (61) that reduces corrosion and improves manufacturing costs of the club head. The club head (42) preferably has a volume in the range of 290 cubic centimeters to 600 cubic centimeters, a weight in the range of 165 grams to 300 grams, and a striking plate portion (72) surface area in the range of 4.00 square inches to 7.50 square inches.

12 Claims, 16 Drawing Sheets

U.S. PATENT DOCUMENTS 5,346,216 A 9/1994 Aizawa
5,377,986 A 1/1995 Viollaz et al.
5,398,935 A 3/1995 Katayamo
5,410,798 A 5/1995 Lo
5,425,538 A 6/1995 Vincent et al.
5,464,210 A 11/1995 Davis et al.
5,474,296 A 12/1995 Schmidt et al.
5,494,281 A 2/1996 Chen
5,499,814 A 3/1996 Lu
5,516,107 A 5/1996 Okumoto et al.
5,538,246 A 7/1996 Dekura
5,547,427 A 8/1996 Rigal et al.
5,570,886 A 11/1996 Rigal et al.
5,624,331 A 4/1997 Lo et al.
5,720,674 A 2/1998 Galy
5,743,813 A 4/1998 Chen et al.
5,766,089 A 6/1998 Dekura
5,776,011 A 7/1998 Su et al.
5,830,084 A 11/1998 Kosmatka
5,851,160 A 12/1998 Rugge et al.
5,863,261 A 1/1999 Eggiman
5,888,149 A 3/1999 Allen
6,146,571 A 11/2000 Vincent et al.
6,149,534 A 11/2000 Peters et al.
6,152,833 A 11/2000 Werner et al.
6,165,081 A 12/2000 Chou
6,306,048 B1 10/2001 McCabe et al.
6,332,848 B1 12/2001 Long et al.
6,354,962 B1 3/2002 Galloway et al.
6,386,990 B1 5/2002 Reyes et al.
6,398,666 B1 6/2002 Evans et al.
6,440,011 B1 8/2002 Hocknell et al.
6,491,592 B2 12/2002 Cackett et al.
6,506,129 B2 * 1/2003 Chen ..... 473/329
6,533,679 B1 3/2003 McCabe et al.
6,672,975 B1 * 1/2004 Galloway ..... 473/342
2002/0187853 A1 12/2002 Beach et al.
2003/0054901 A1 * 3/2003 Sun ..... 473/342
2004/0176181 A1 * 9/2004 Meyer et al. ..... 473/329

* cited by examiner

09/16

GOLF CLUB HEAD WITH GASKET

FEDERAL RESEARCH STATEMENT

[Not Applicable]

BACKGROUND OF INVENTION

1. Field of the Invention

The present invention relates to a golf club head with a face component, an aft-body and a gasket disposed between the face component and aft-body. More specifically, the present invention relates to a golf club head with a face component, an aft-body and a gasket disposed between the face component and aft-body to create an improved barrier between the face and body of the golf club head.

2. Description of the Related Art

Golf clubs can be manufactured in several ways. One approach is to bond a face component to a separate body using an adhesive. In this operation, the dispersion and application of the adhesive and removal of any residual adhesive results in increased costs. Additional cosmetics, such as a trim line between the mated face components and body may require filler material that must be cured and cleaned after cure. The additional steps and materials increase manufacturing time as well as the likelihood of introducing defects to the manufacturing process. The quality of the finished product is dependant on the relative skill of the worker. Moreover, the combination of dissimilar materials in the face and body can increase the likelihood of corrosion. Thus, in many golf club heads, the manufacturing processes require increased labor and skill and are subject to the effects of corrosion between dissimilar materials.

In order to improve the performance of golf club heads, many golf club manufacturers produce golf clubs with separate face plates that are bonded to the golf club body. However, there is a need for a golf club head with a face-body interface that is more corrosion resistant than that of a conventional golf club and provides cost savings.

SUMMARY OF INVENTION

The present invention provides a solution to the cost-effective production of golf clubs while providing golfers with golf clubs that they currently play and trust to give them optimal performance. The present invention is able to accomplish this by providing a wood-type golf club head with an insert for improved barrier and corrosion resistance between the golf club face and body.

The present invention overcomes problems of the prior art by providing a golf club head that comprises a face component, an aft-body and a gasket disposed between the face component and the aft-body. The gasket creates an improved barrier for reducing corrosion, while reducing assembly time and improving consistency among golf club heads.

In accordance with an embodiment of the invention, a golf club head includes a face includes a face component, an aft-body and a gasket. The face component has a striking plate portion and a return portion. The aft body, which includes a crown portion and a sole portion, is attached to the return portion of the face component. The gasket is positioned in a gap between the face component and the aft-body. The gasket may be composed of a polymer material, such as a thermoplastic polyurethane elastomer material. The gasket preferably has a width in the range of 0.010 inch to 0.020 inch. Different portions of the gasket may have different cross-sectional configurations.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
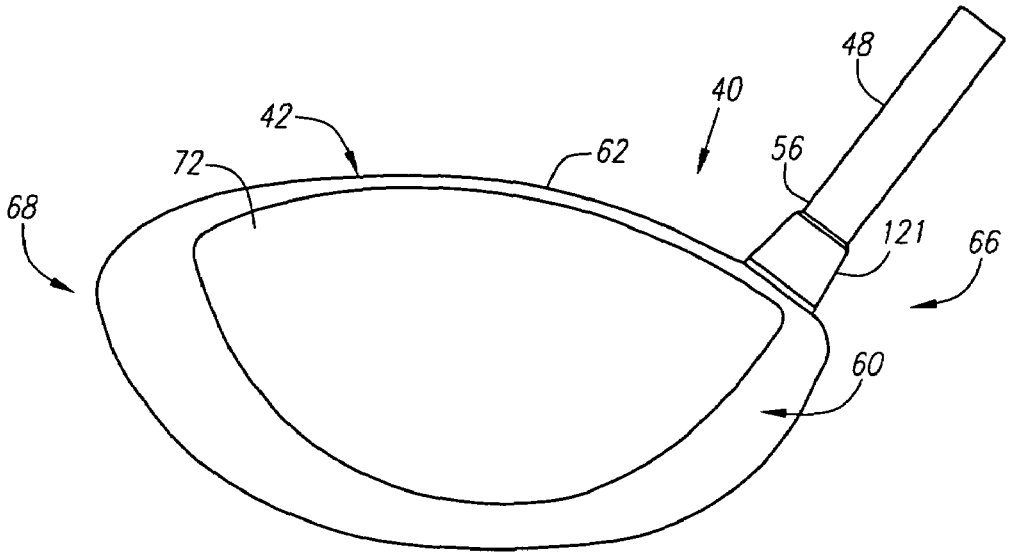
FIG. 1 is a front view of a golf club.

As shown in FIG. 1, a golf club is generally designated 40. The golf club 40 has a golf club head 42. Engaging the club head 42 is a shaft 48 that has a grip 50, not shown, at a butt end 52 and is inserted into a hosel 54 at a tip end 56.

As shown in FIGS. 1A-8, the club head 42 is generally composed of a face component 60, an aft-body 61 and a gasket 300. As explained in greater detail below, the gasket 300 is disposed between the face component 60 and the aft-body 61. The aft-body is preferably composed of an upper section 200 and a lower section 202, which are joined together to form the aft-body 61. The aft-body 61 preferably has a crown portion 62 and a sole portion 64. The golf club head 42 is preferably has a heel end 66 nearest the shaft 48, a toe end 68 opposite the heel end 66, and a rear end 70 opposite the face component 60.

The face component 60 is generally composed of a single piece of metal, and is preferably composed of a forged metal material. More preferably, the forged metal material is a forged titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Alternatively, the face component 60 is manufactured through casting, forming, machining, powdered metal forming, metal-injection-molding, electro chemical milling, and the like.

FIGS. 19-23 illustrate the face component 60 in isolation. The face component 60 generally includes a striking plate portion (also referred to herein as a face plate) 72 and a return portion 74 extending laterally inward from the perimeter of the striking plate portion 72. The striking plate portion 72 typically has a plurality of scorelines 75 thereon.

In a preferred embodiment, the return portion 74 generally includes an upper lateral section 76, a lower lateral section 78, a heel lateral section 80 and a toe lateral section 82. Thus, the return 74 preferably encircles the striking plate portion 72 a full 360 degrees. However, those skilled in the pertinent art will recognize that the return portion 74 may only encompass a partial section of the striking plate portion 72, such as 270 degrees or 180 degrees, and may also be discontinuous.

The upper lateral section 76 extends inward, towards the aft-body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the striking plate portion 72 to the rearward edge of the upper lateral section 76. In a preferred embodiment, the upper lateral section 76 has a general curvature from the heel end 66 to the toe section 68. The upper lateral section 76 has a length from the perimeter 73 of the striking plate section 72 that is preferably a minimal length near the center of the striking plate section 72, and increases toward the toe end 68 and the heel end 66.

The perimeter 73 of the striking plate portion 74 is defined as the transition point where the face component 60 transitions from a plane substantially parallel to the striking plate portion 72 to a plane substantially perpendicular to the striking plate portion 72. Alternatively, one method for determining the transition point is to take a plane parallel to the striking plate portion 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking plate portion 72.

The present invention preferably has the face component 60 engage the crown portion 62 along a substantially horizontal plane. The crown 62 has a crown undercut portion 62*a*, which is placed under the return portion 74. Such an engagement enhances the flexibility of the striking plate portion 72 allowing for a greater coefficient of restitution. The crown portion 62 and the upper lateral section 76 are attached to each other as further explained below.

The heel lateral section 80 is substantially perpendicular to the striking plate portion 72, and the heel lateral section 80 covers the hosel 54 before engaging an optional ribbon section 90 and a bottom section 91 of the sole portion 64 of the aft-body 61. The heel lateral section 80 is attached to the sole 64, both the ribbon 90 and the bottom section 91, as explained in greater detail below. The heel lateral section 80 extends inward a distance, d''', from the perimeter 73 a distance of 0.250 inch to 1.50 inches, more preferably 0.50 inch to 1.0 inch, and most preferably 0.950 inch. The heel lateral section 80 preferably has a general curvature at its edge.

At the other end of the face component 60 is the toe lateral section 82. The toe lateral section 82 is attached to the sole 64, both the ribbon 90 and the bottom section 91, as explained in greater detail below. The toe lateral section 82 extends inward a distance, d'', from the perimeter 73 a distance of 0.250 inch to 1.50 inches, more preferably 0.75 inch to 1.30 inch, and most preferably 1.20 inch. The toe lateral section 80 preferably has a general curvature at its edge.

The lower lateral section 78 extends inward, toward the aft-body 61, a distance, d', to engage the sole 64. In a preferred embodiment, the distance d' ranges from 0.2 inch to 1.25 inches, more preferably 0.50 inch to 1.10 inch, and most preferably 0.9 inch, as measured from the perimeter 73 of the striking plate portion 72 to the edge of the lower lateral section 78.

The sole portion 64 has a sole undercut 64*a* for placement under the return portion 74. The sole 64 and the lower lateral section 78, the heel lateral section 80 and the toe lateral section 82 are attached to each other as explained in greater detail below.

The aft-body 61 is preferably composed of an upper section 200 and a lower section 202, which are joined together to form the aft-body 61. The aft-body 61 is preferably composed of a low density material, preferably a metal or a polymer material. Preferably metals include magnesium alloys, aluminum alloys, magnesium or aluminum material. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The aft-body 61 is preferably manufactured through metal-injection-molding, casting, forming, machining, powdered metal forming, electro chemical milling, and the like. Alternatively, the aft-body is composed of a polymer material such as plies of prepreg material, thermoplastic materials such as polyurethanes, polyesters, polyamides, ionomers, and other similar materials.

The face component 60 is preferably adhered to the aft-body 61 with an adhesive, which is preferably placed on the interior surface of the return portion 74. The adhesive may also be placed on the undercut portions 62*a* and 64*a*. The upper section 200 is preferably adhered to the lower section 202 with an adhesive. Such adhesives include thermosetting adhesives in a liquid or a film medium. A preferred adhesive is a two part liquid epoxy sold by 3M of Minneapolis Minnesota under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

The gasket 300 is preferably composed of a polymer material. One such material is a thermoplastic polyurethane elastomer. The gasket 300 is preferably a single continuous piece. However, those skilled in the pertinent art will recognize that the gasket 300 may be composed of multiple pieces that are positioned within the annular gap 170. The gasket 300 preferably has a thickness, "T", ranging from 0.020 inch to 0.100 inch, more preferably from 0.040 inch to 0.080 inch, and most preferably 0.060 inch. The gasket 300 preferably "encircles" the entire golf club head 42. The gasket 300 is preferably placed within the annular gap 170. The annular gap 170 is located rearward from the striking plate portion 72, and preferably ranges from 0.10 inch to 3.0 inches from the perimeter 73 of the striking plate portion 72 depending on the length of the golf club head 42. Preferably, the annular gap 170 is positioned along the front half of the golf club head 42, however, those skilled in the pertinent art will recognize that the annular gap may be positioned along the rear half of the golf club head 42.

Figure 13:
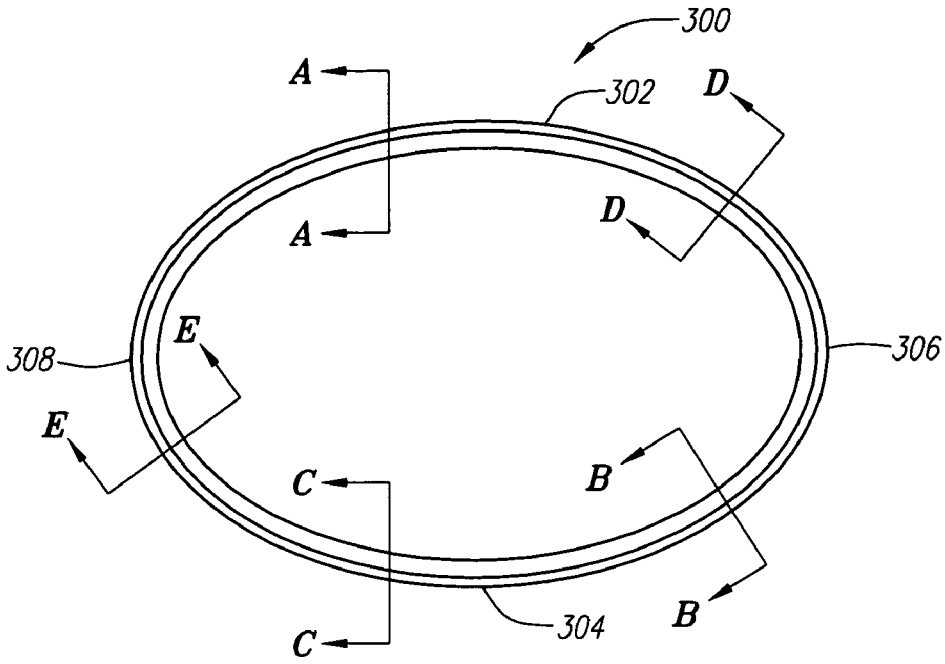
FIG. 13 is an isolated front view of a gasket.
Figure 13A:
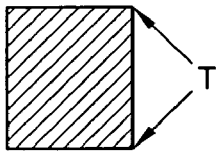
FIG. 13A is a cross-sectional view along line A-A of FIG. 13.
Figure 13B:
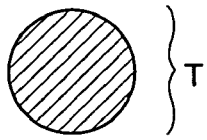
FIG. 13B is a cross-sectional view along line B-B of FIG. 13.
Figure 13C:
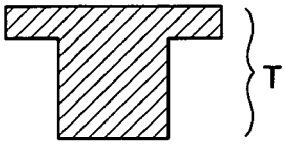
FIG. 13C is a cross-sectional view along line C-C of FIG. 13.
Figure 13E:
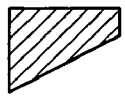
FIG. 13E is a cross-sectional view along line E-E of FIG. 13.
Figure 13D:
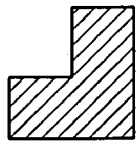
FIG. 13D is a cross-sectional view along line D-D of FIG. 13.
Figure 28:
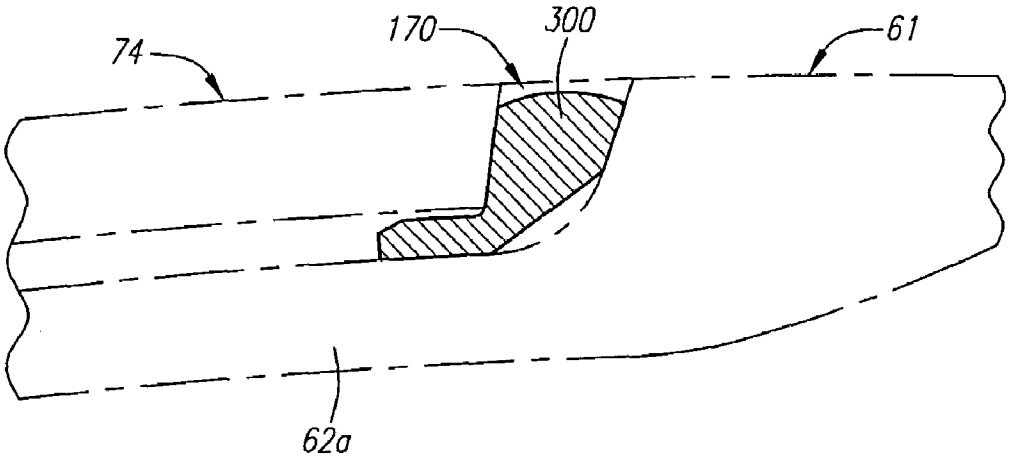
FIG. 28 is a cross-sectional view of a gasket with L shape.
Figure 29:
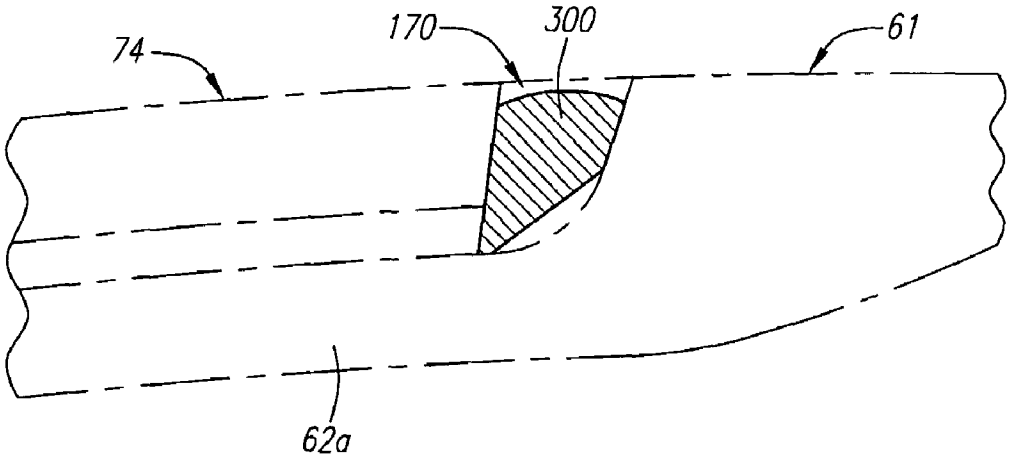
FIG. 29 is a cross-sectional view of the gasket with wedge shape.

As shown in FIG. 13, the gasket 300 preferably has a width, "W1", that ranges from 0.010 inch to 0.200 inch, more preferably from 0.040 to 0.120 inch, most preferably 0.075 inches. In the preferred embodiment shown in FIG. 28, the gasket has an "L" shaped cross section with the "OML" surface width with that ranges from 0.010 inch to 0.190 inch, more preferably from 0.030 inch to 0.100 inch, most preferably from 0.040 inch to 0.080 inch and a lip that ranges from 0.010 inch to 0.150 inch, more preferably from 0.040 inch to 0.120 inch, and most preferably 0.080 inch. In an alternative embodiment as shown by FIG. 29, the gasket can have a wedge shaped cross section with an the "OML" surface width with that ranges from 0.010 inch to 0.190 inch, more preferably from 0.030 inch to 0.100 inch, most preferably from 0.040 inch to 0.080 inch and a bottom width that ranges from 0.010 inch to 0.100 inch, more preferably from 0.020 inch to 0.070 inch, and most preferably 0.020 inch. In additional alternative embodiments the cross section may have square, rectangular, round, circular, or any other plurality of geometric cross sections of differing widths, as shown in FIGS. 13A-E.

The gasket 300 is preferably attached to the crown undercut portion 62*a* and the sole undercut portion 64*a* prior to attaching the face component 60 to the aft-body 61. The gasket 300 is preferably attached to the crown undercut portion 62*a* and the sole undercut portion 64*a* using an adhesive such as described above.

Figure 24:
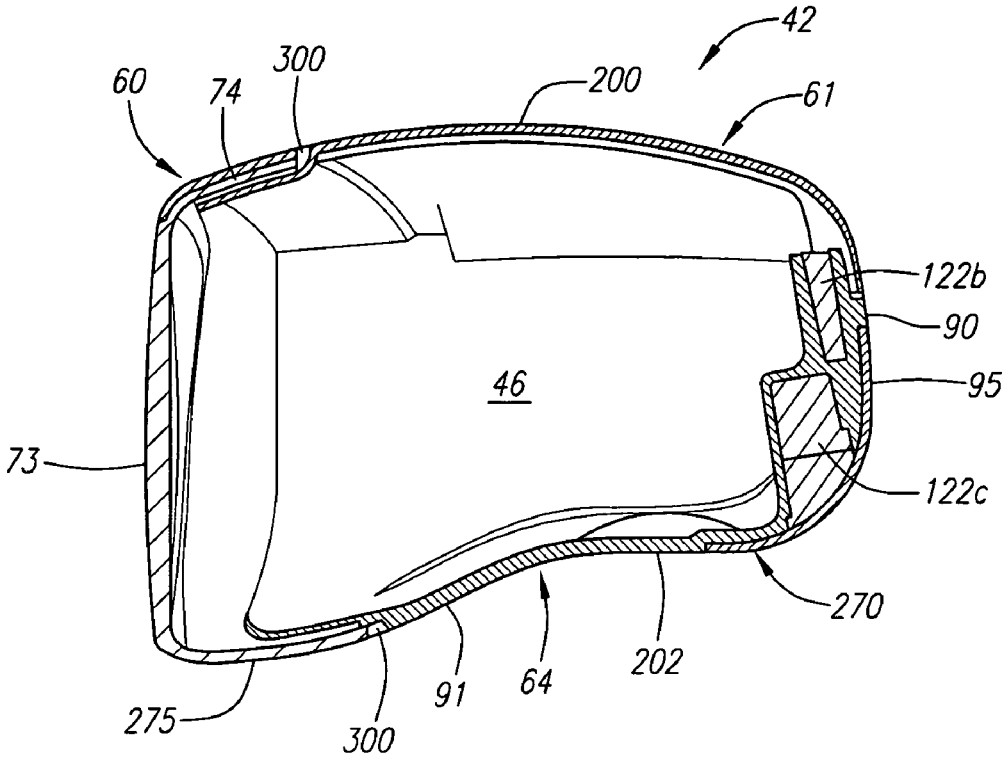
FIG. 24 is a cut-away view along line 24-24 of FIG. 7.
Figure 25:
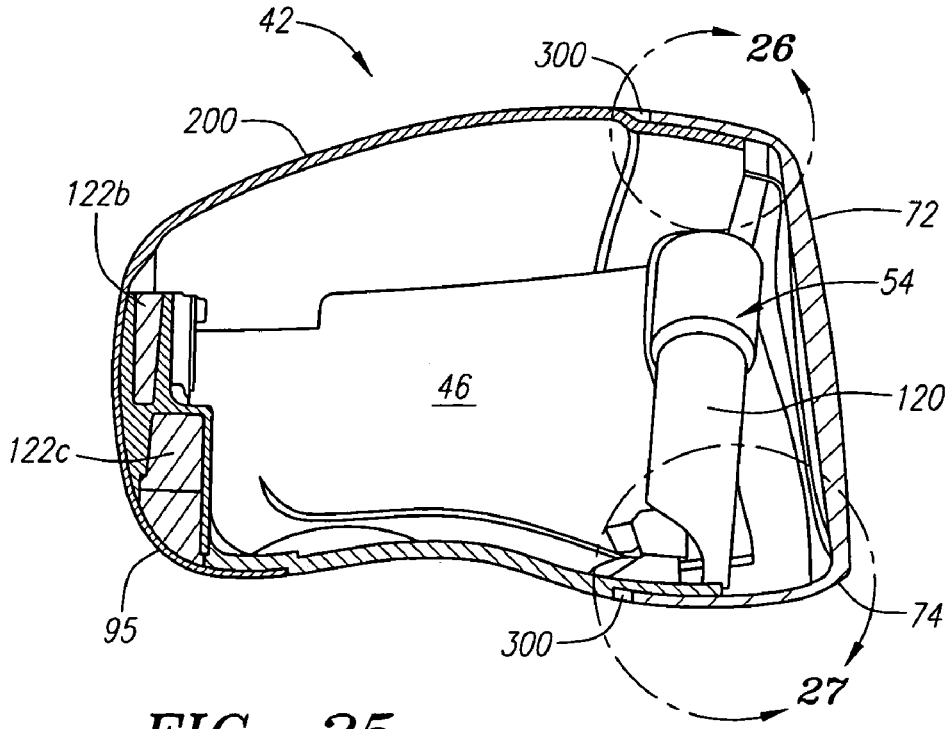
FIG. 25 is a cut-away view along line 25-25 of FIG. 7.
Figure 26:
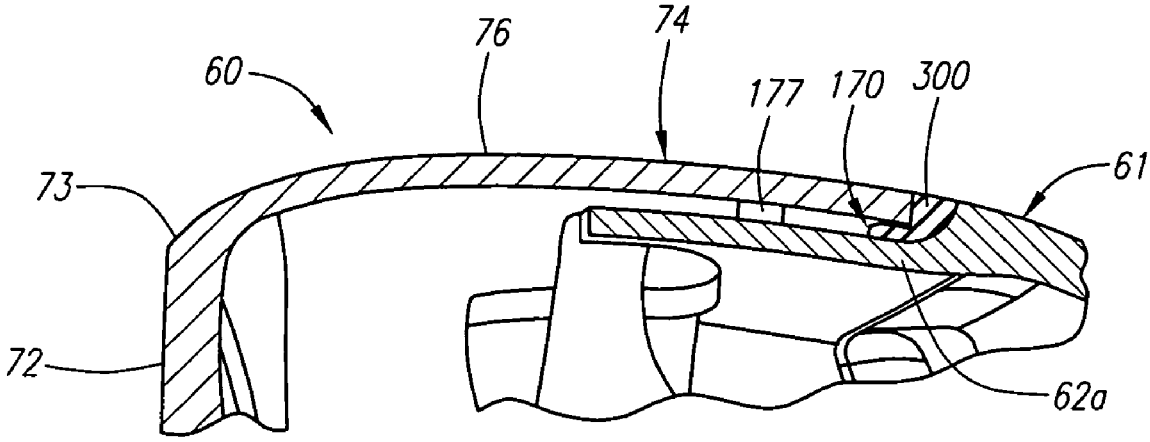
FIG. 26 is an enlarged view of circle 27 of FIG. 25.
Figure 27:
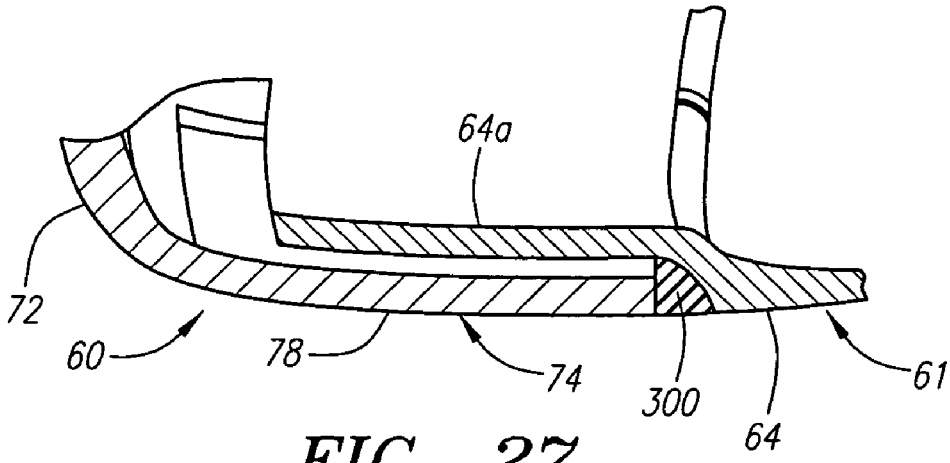
FIG. 27 is an enlarged view of circle 28 of FIG. 25.

As shown in FIGS. 24 and 25, the return portion 74 overlaps the undercut portions 62*a* and 64*a* a distance ranging from 0.25 inch to 1.00 inch, more preferably ranges from 0.40 inch to 0.70 inch, and is most preferably 0.50 inch. An annular gap 170 is created between an edge 190 of the crown portion 62 and the sole portion 64, and an edge 195 of the return portion 74. The annular gap 170 preferably has a distance from the edge 190 of the crown portion 62 to the edge 195 of the return portion 74 ranging from 0.020 inch to 0.100 inch, more preferably from 0.050 inch to 0.070 inch, and is most preferably 0.060 inch. A plurality of projections 177 on an upper surface of the undercut portions 62*a* and 64*a* establishes a minimum bond thickness between the interior surface of the return portion 74 and the upper surface of the undercut portions 62*a* and 64*a*. The bond thickness preferably ranges from 0.002 inch to 0.100 inch, more preferably ranges from 0.005 inch to 0.040 inch, and is most preferably 0.030 inch. A liquid adhesive preferably secures the aft body 61 to the face component 60. A leading edge of the undercut portions 62*a* and 64*a* may be sealed to prevent the liquid adhesive from entering the hollow interior 46.

Figure 14:
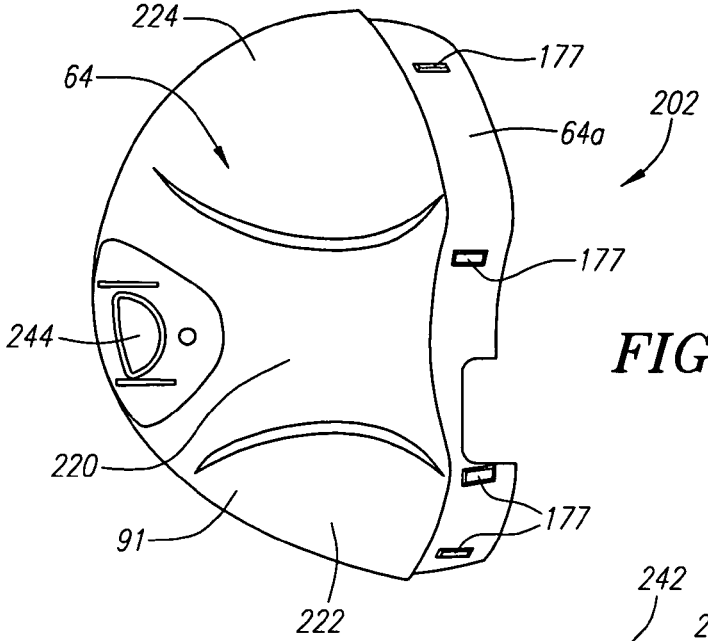
FIG. 14 is an isolated bottom view of a lower section of an aft-body of the golf club head.
Figure 15:
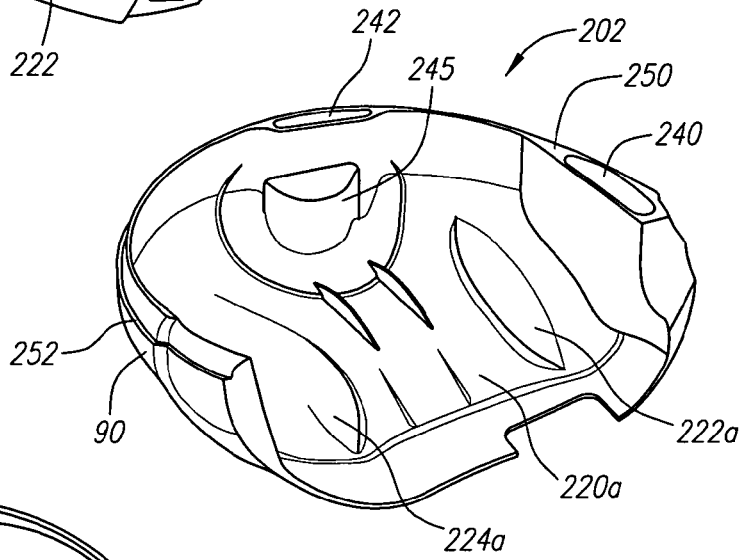
FIG. 15 is a top perspective view of the lower section of the aft-body of FIG. 14.
Figure 16:
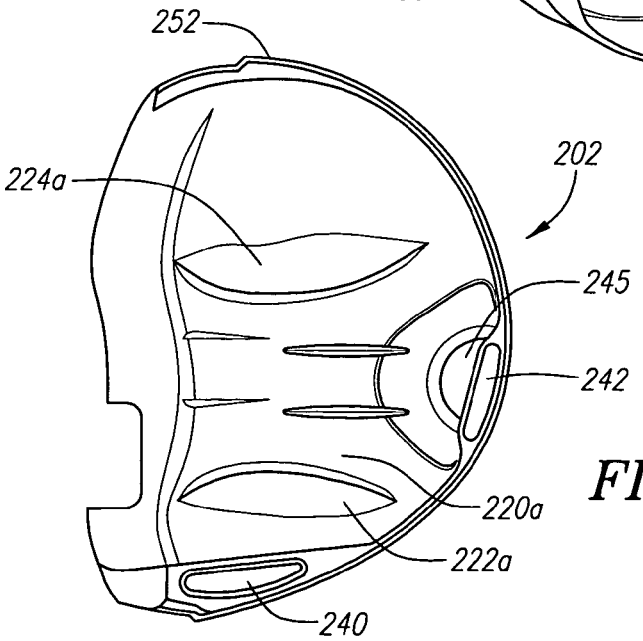
FIG. 16 is a top plan view of the lower section of the aft-body of FIG. 14.

FIGS. 14-16 illustrate a preferred embodiment of the lower section 202 of the aft-body 61. The sole portion 64, including the bottom section 91 and the optional ribbon 90 which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The undercut portion 64*a* has a similar thickness to the sole portion 64. The lower section 202 preferably comprises the bottom section 91 and a lower portion of the ribbon 90. The bottom section 91 preferably has a medial ridge 220 which extends from the undercut portion 64*a* rearward. A heel convex portion 222 is preferably located on a heel end 66 next to the medial ridge 220 and a toe convex portion 224 is preferably located on a toe end 68 next to the medial ridge 220. An alternative embodiment of the bottom section 91 is disclosed in U.S. Pat. No. 5,480,152, entitled Hollow, Metallic Golf Club Head With Relieved Sole And Dendritic Structures, assigned to Callaway Golf Company, and which pertinent parts are hereby incorporated by reference.

An aft weight cavity 244 is preferably located rearward of the medial ridge 220. The aft weight cavity 244 preferably allows swing weighting of the golf club head 42. The aft-weight cavity 244 is accessible from the exterior of the golf club head 42 was all of the components are joined together. The interior of lower section 202 has a heel weight cavity 240 and a rear weight cavity 242 for placement of mass prior to the joining of components of the golf club head 42. The interior surface 220*a* of the medial ridge 220 creates a depression in the interior surface of the lower section 202 while the interior surfaces 222*a* and 224*a* of the heel convex portion 222 and toe convex portion 224 create projections in the interior surface of the lower section 202. A wall 245 of the aft-weight cavity 244 projects inward from the interior surface of the lower section 202. The lower section 2020 has a first ledge 250 and a section ledge 252.

Figure 17:
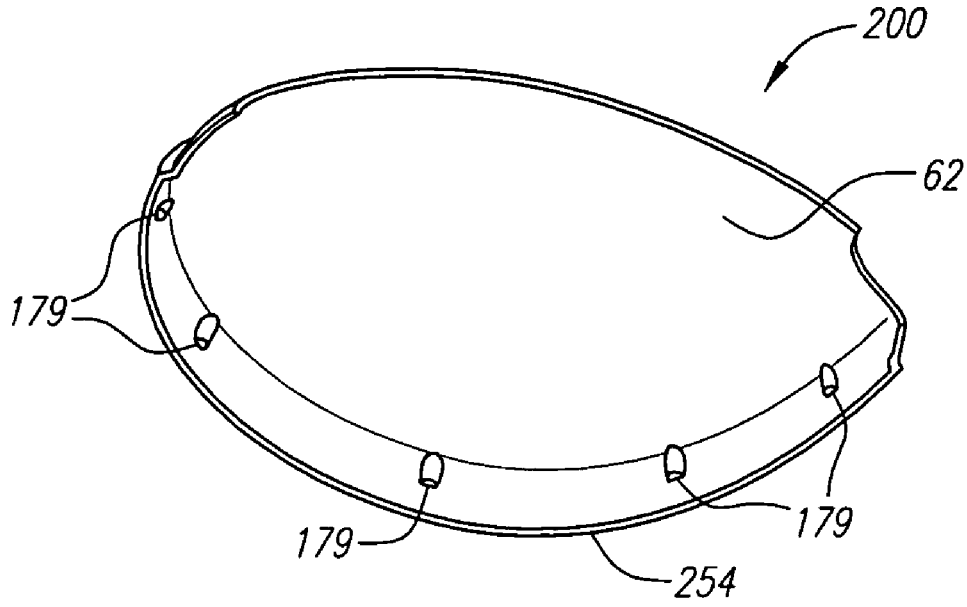
FIG. 17 is an isolated interior view of an upper section of an aft-body of the golf club head.
Figure 18:
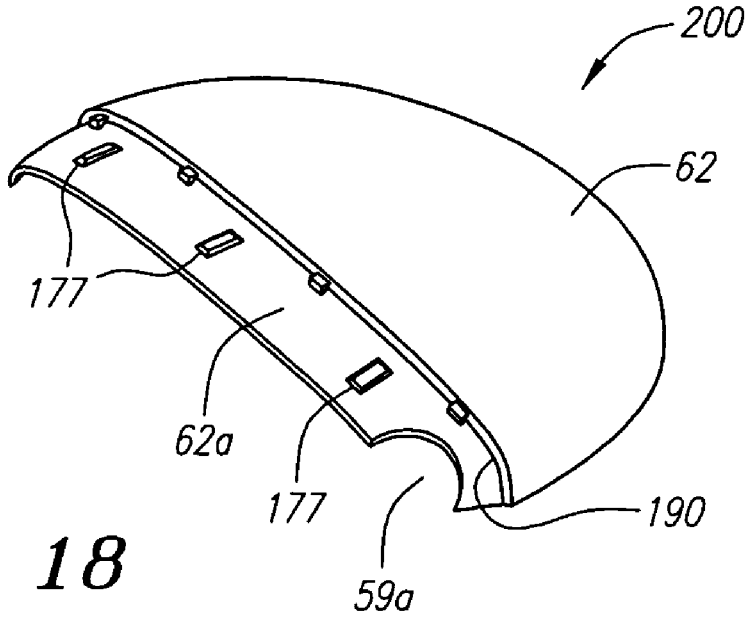
FIG. 18 is an isolated top perspective view of the upper section of the aft-body of FIG. 17.
Figure 19:
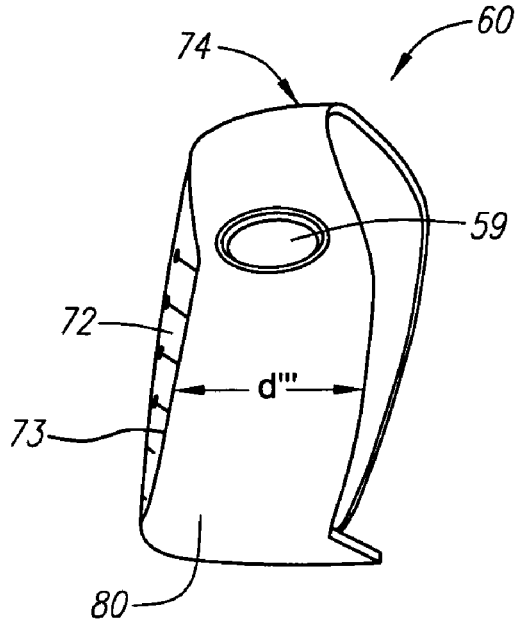
FIG. 19 is an isolated heel view of a face component of the golf club head.
Figure 20:
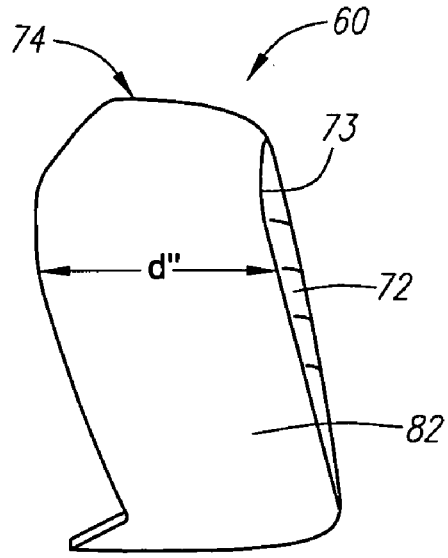
FIG. 20 is an isolated toe view of the face component of FIG. 19.
Figure 21:
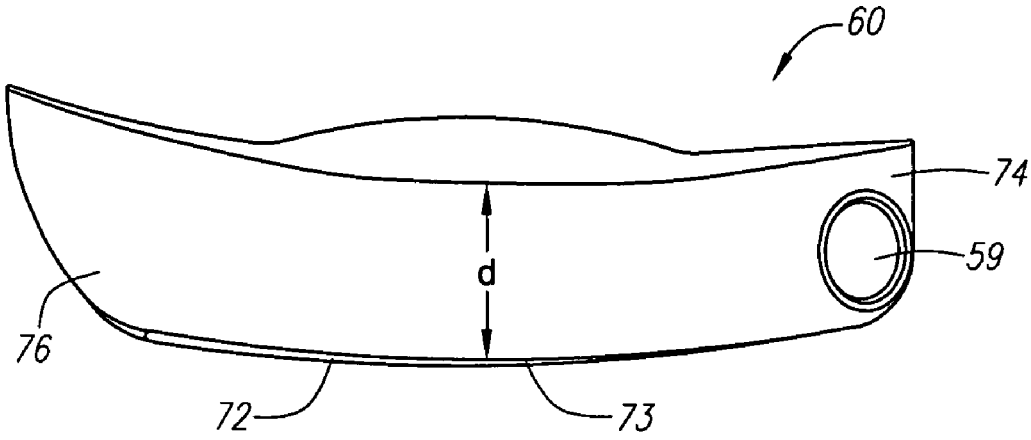
FIG. 21 is an isolated top plan view of the face component of FIG. 19.
Figure 22:
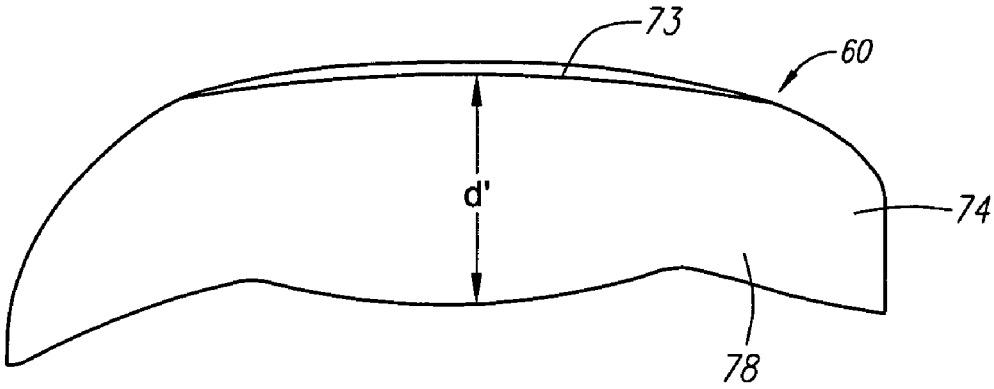
FIG. 22 is an isolated bottom plan view of the face component of FIG. 19.

FIGS. 17-18 illustrate the upper section 200 of the aft-body 61. The upper section 200 preferably comprises the crown portion 62 and an upper section of the ribbon 90. The crown portion 62 of the aft-body 61 is generally convex toward the sole 64, and engages the ribbon 90 of sole 64 outside of the engagement with the face member 60. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The undercut portion 62*a* has a similar thickness to the crown portion 62. The interior surface of the upper section 200 has a plurality of interior projections 179 the engage the first ledge 250 of the lower section 202. The upper section 200 has a first ledge 254 that engages the second ledge 252 of the lower section 202. As explained above, the upper section 200 and the lower section 202 are joined together preferably through use of an adhesive. An aft-body gap 205 is preferably created upon joining of the upper section 200 and the lower section 202. The crown undercut portion 62*a* has a plurality of undercut projections 177 extending upward from an exterior surface.

FIGS. 24-25 illustrate the hollow interior 46 of the club head 42. The hosel 54 is disposed within the hollow interior 46, and is located as a part of the face component 60. The hosel 54 may be composed of a similar material to the face component 60, and is preferably secured to the face component 60 through welding or the like. The hosel 54 may also be formed with the formation of the face component 60. Additionally, the hosel may be composed of a non-similar material that is light weight and secured using bonding or other mechanical securing techniques. A hollow interior of the hosel 54 is defined by a hosel wall 120 that forms a tapering tube from the aperture 59 to the sole potion 64. The shaft 48 is disposed within a hosel insert 121 that is disposed within the hosel 54. Such a hosel insert 121 and hosel 54 are described in U.S. Pat. No. 6,352,482, entitled Golf Club With Hosel Liner, which pertinent parts are hereby incorporated by reference. Alternatively, to provide greater capability as to the control of the face angle of the golf club head 42, an insert and hosel liner combination such as disclosed in U.S. Pat. No. 6,475,100 is utilized, and U.S. Pat. No. 6,475,100 is hereby incorporated by reference in its entirety.

Figure 23:
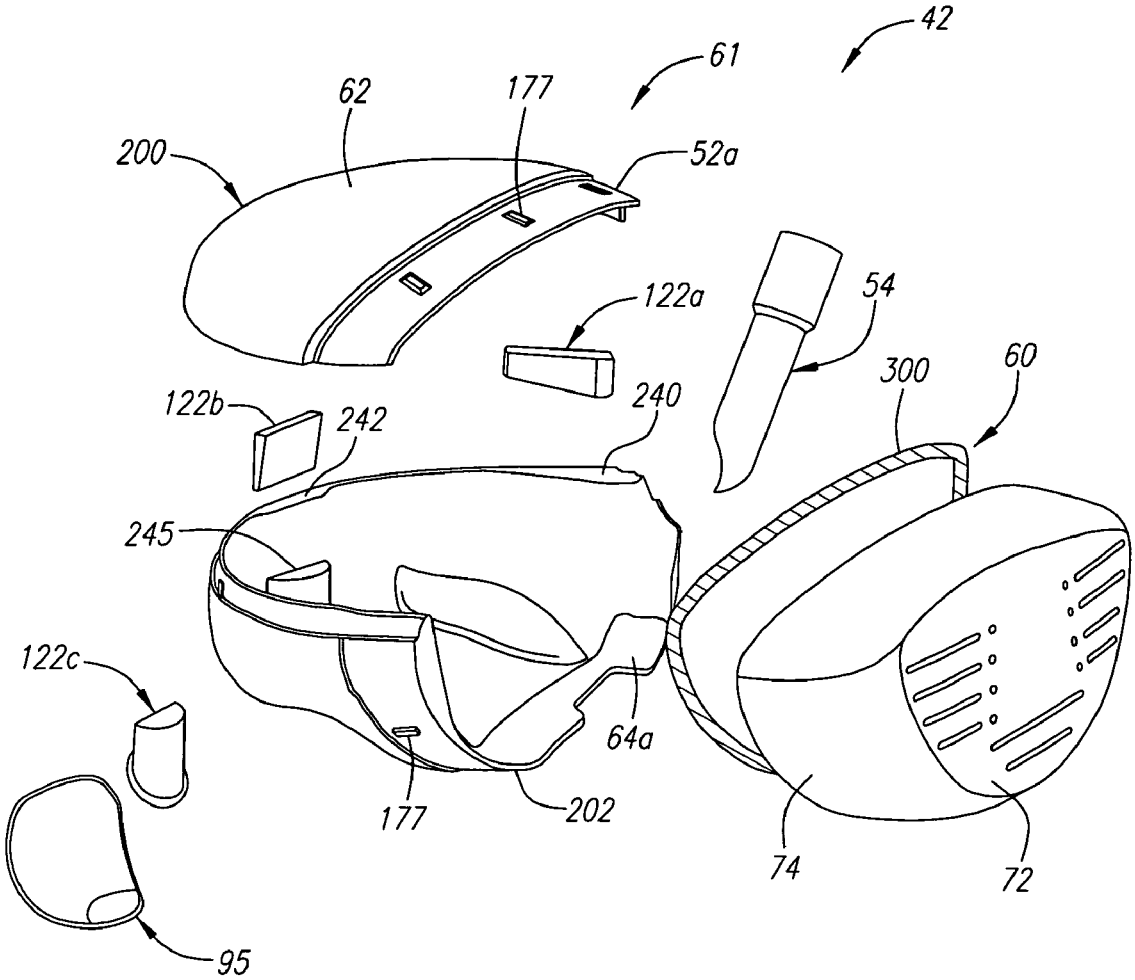
FIG. 23 is an exploded view of a golf club head.

As shown in FIG. 23, weighting members 122*a*, 122*b* and 122*c* are preferably disposed within the heel weight cavity 240, the rear weight cavity 242 and the aft-weight cavity 244, respectively. In a preferred embodiment, all of the weighting members 122*a*, 122*b* and 122*c* are utilized in order to increase the moment of inertia and control the center of gravity of the golf club head 42. However, those skilled in the pertinent art will recognize that none or only one or two of the weighting members 122*a*, 122*b* and 122*c*, and also additional weighting members may be placed in locations of the club head 42 in order to influence the center of gravity, moment of inertia, or other inherent properties of the golf club head 42. A preferred use of weighting members to influence the center of gravity of the a golf club head is disclosed in co-pending U.S. patent application Ser. No. 10/249,510, filed on Apr. 15, 2003, for a Golf Club Head With Customizable Center Of Gravity, and assigned to Callaway Golf Company, which is hereby incorporated by reference in its entirety.

In a preferred embodiment, the weighting members 122*a*, 122*b* and 122*c* are bonded within the heel weight cavity 240, the rear weight cavity 242 and the aft-weight cavity 244, respectively. Individually, each of the weighting members 122*a*, 122*b* and 122*c* has a mass ranging from 10 grams to 30 grams, preferably from 14 grams to 25 grams, and more preferably from 15 grams to 20 grams. Each of the weighting members 122*a*, 122*b* and 122*c* has a density ranging from 5 grams per cubic centimeters to 20 grams per cubic centimeters, more preferably from 7 grams per cubic centimeters to 12 grams per cubic centimeters, and most preferably 8.0 grams per cubic centimeters.

The metal material of each of the weighting members 122*a*, 122*b* and 122*c* is preferably selected from copper, tungsten, steel, aluminum, tin, silver, gold, platinum, or the like. A preferred metal is tungsten due to its high density. The polymer material of each of the weighting members 122*a*, 122*b* and 122*c* is preferably a thermoplastic or thermosetting polymer material. A preferred polymer material is polyurethane, epoxy, nylon, polyester, or similar materials. A most preferred polymer material is a thermoplastic polyurethane. The weighting members 122*a*, 122*b* and 122*c* are preferably composed an injection molded thermoplastic polyurethane integrated with tungsten to have a density of 8.0 grams per cubic centimeters. In a preferred embodiment, each of the weighting members 122*a*, 122*b* and 122*c* are composed of from 50 to 95 volume percent polyurethane and from 50 to 5 volume percent tungsten. Also, in a preferred embodiment, each of the weighting members 122*a*, 122*b* and 122*c* are composed of from 10 to 25 weight percent polyurethane and from 90 to 75 weight percent tungsten. Those skilled in the pertinent art will recognize that other high density materials may be utilized as an optional weighting member without departing from the scope and spirit of the present invention. Alternatively, the ribbon section 90 may have a thickened region to provide mass for the aft-body 61.

FIG. 13 illustrates a preferred embodiment of the face component of the golf club head 42. FIG. 13 illustrates the variation in the thickness of the striking plate portion 72. The striking plate portion 72 is preferably partitioned into elliptical regions, each having a different thickness. In a preferred embodiment in which the face component 60 is composed of a titanium or titanium alloy material, a central elliptical region 102 preferably has the greatest thickness that ranges from 0.120 inch to 0.090 inch, preferably from 0.115 inch to 0.100 inch, and is most preferably 0.105 inch. The central elliptical region 102 preferably has a uniform thickness. A first concentric region 104 preferably has the next greatest thickness that ranges from 0.110 inch to 0.076 inch, preferably from 0.100 inch to 0.086 inch, and is most preferably 0.088 inch. The first concentric region preferably has a thickness that transitions from the first concentric region 102 thickness to the periphery region 110 thickness. A periphery region 110 preferably has the next greatest thickness that ranges from 0.082 inch to 0.062 inch, and is most preferably 0.072 inch. The variation in the thickness of the striking plate portion 72 allows for the greatest thickness to be localized in the center 111 of the striking plate portion 72 thereby maintaining the flexibility of the striking plate portion 72 which corresponds to less energy loss to a golf ball and a greater coefficient of restitution without reducing the durability of the striking plate portion 72.

Other alternative embodiments of the thickness of the striking plate portion 72 are disclosed in U.S. Pat. No. 6,471,603, for a Contoured Golf Club Face and U.S. Pat. No. 6,398,666 for a Golf Club Striking Plate With Variable Thickness, which are both owned by Callaway Golf Company and which pertinent parts are hereby incorporated by reference.

As mentioned previously, the face component 60 is preferably forged from a rod of metal material. One preferred forging process for manufacturing the face component is set forth in U.S. Pat. No. 6,440,011, entitled Method For Processing A Striking Plate For A Golf Club Head, owned by Callaway Golf Company, and hereby incorporated by reference in its entirety. Alternatively, the face component 60 is cast from molten metal in a method such as the well-known lost-wax casting method. Additional methods for manufacturing the face component 60 include forming the face component 60 from a flat sheet of metal, super-plastic forming the face component 60 from a flat sheet of metal, machining the face component 60 from a solid block of metal, electrochemical milling the face from a forged preform, and like manufacturing methods. Yet further methods include diffusion bonding titanium sheets to yield a variable face thickness face and then superplastic forming.

Alternatively, the face component 60 is composed of an amorphous metal material such as disclosed in U.S. Pat. No.

6,471,604, owned by Callaway Golf Company, and which pertinent parts are hereby incorporated by reference in its entirety.

The present invention is directed at a golf club head that has a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $u_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The coefficient of restitution of the club head 42 under standard USGA test conditions with a given ball preferably ranges from approximately 0.81 to 0.94, preferably ranges from 0.83 to 0.883 and is most preferably 0.87.

Figure 1A:
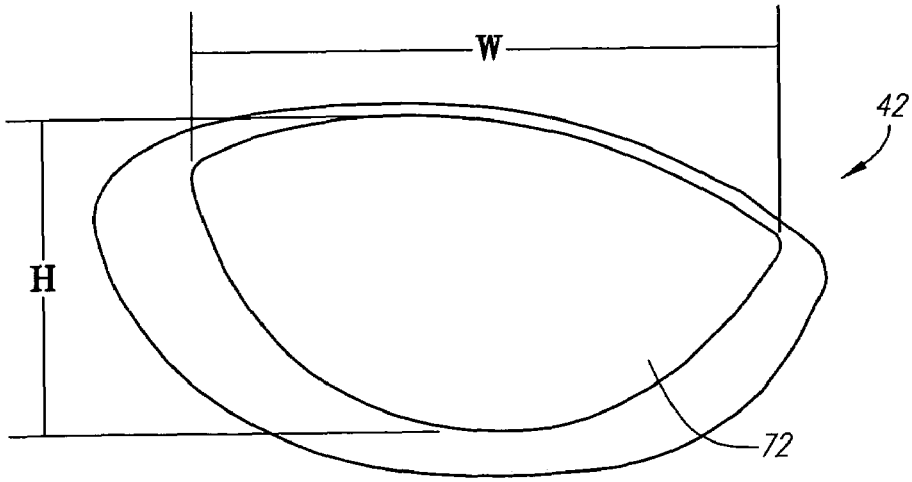
FIG. 1A is a front view of a golf club illustrating the measurement for the aspect ratio of the face.
Figure 2:
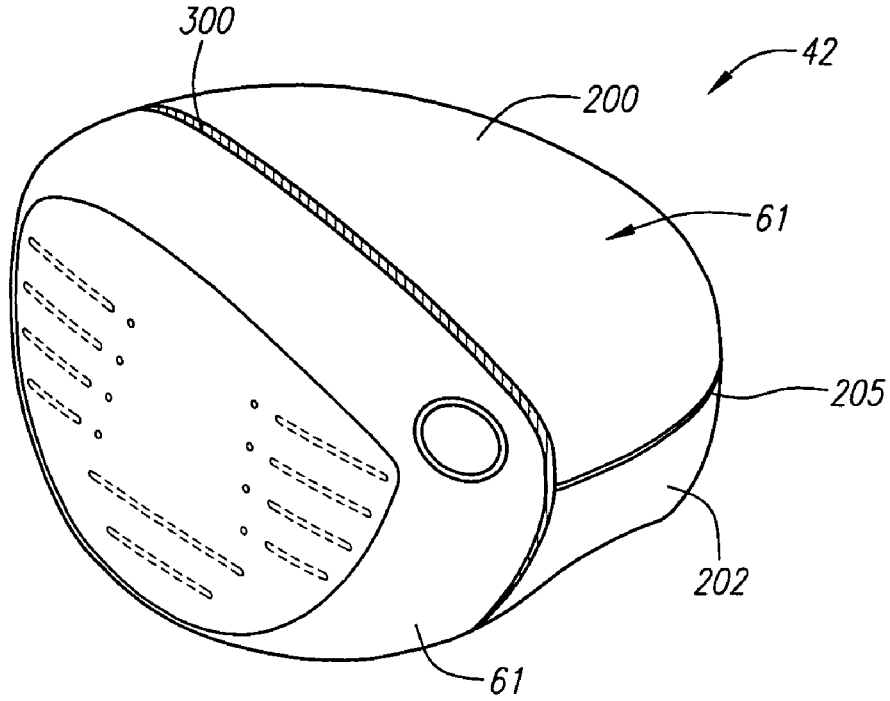
FIG. 2 is a top perspective view of a golf club head.
Figure 3:
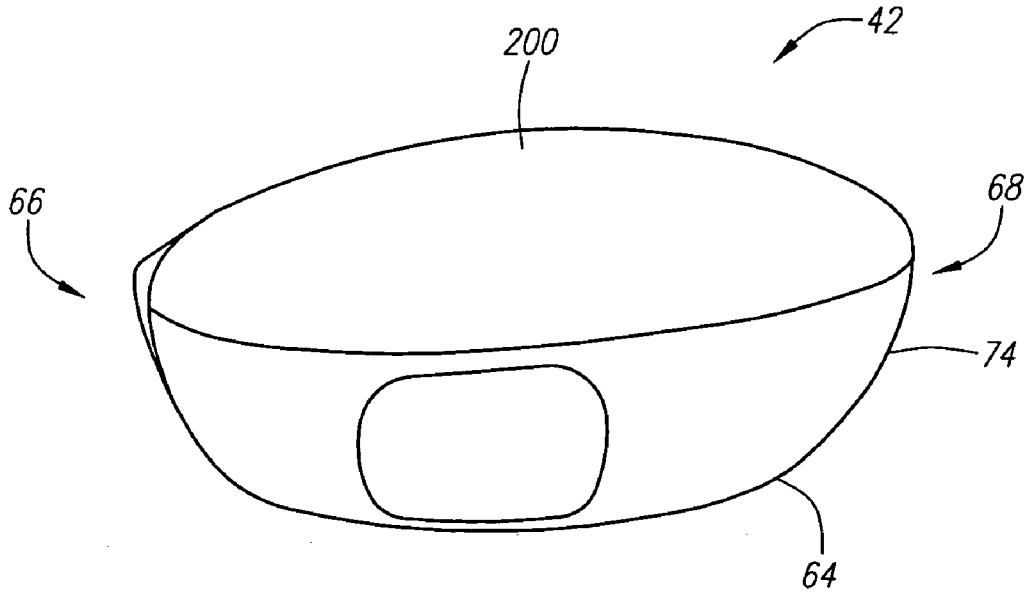
FIG. 3 is rear view of the golf club head of FIG. 2.
Figure 4:
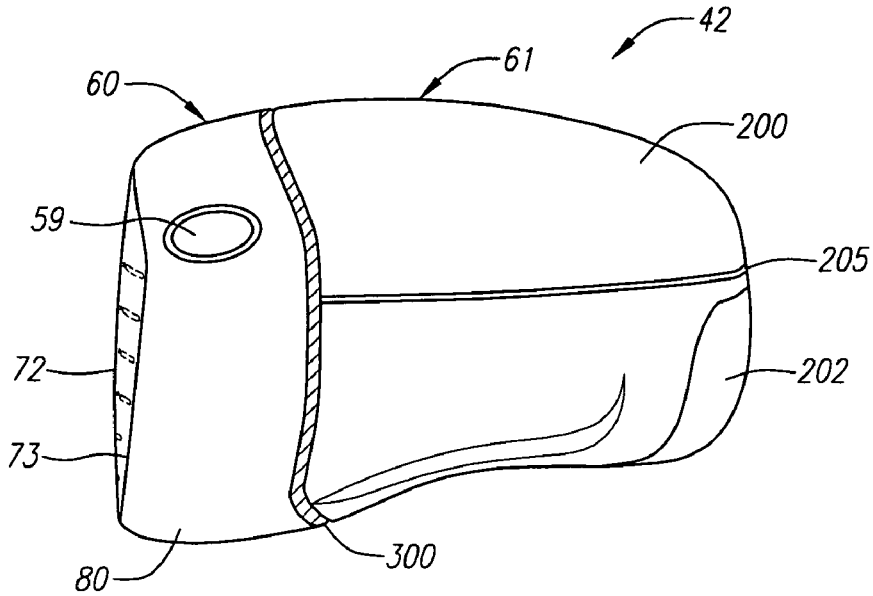
FIG. 4 is a heel side plan view of the golf club head of FIG. 2.

Additionally, the striking plate portion 72 of the face component 60 has a smaller aspect ratio than face plates of the prior art. The aspect ratio as used herein is defined as the width, "W", of the face divided by the height, "H", of the face, as shown in FIG. 1A. In one preferred embodiment, the width W is 78 millimeters and the height H is 48 millimeters giving an aspect ratio of 1.625. In conventional golf club heads, the aspect ratio is usually much greater than 1. For example, the original GREAT BIG BERTHA® driver had an aspect ratio of 1.9. The striking plate portion 72 of the present invention has an aspect ratio that is no greater than 1.7. The aspect ratio of the present invention preferably ranges from 1.0 to 1.7. One embodiment has an aspect ratio of 1.3. The striking plate portion 72 of the present invention is more circular than faces of the prior art. The face area of the striking plate portion 72 preferably ranges from 4.00 square inches to 7.50 square inches, more preferably from 5.00 square inches to 6.5 square inches, and most preferably from 5.8 square inches to 6.0 square inches.

The club head 42 preferably has a greater volume than a club head of the prior art while maintaining a weight that is substantially equivalent to that of the prior art. The volume of the club head 42 of the present invention ranges from 290 cubic centimeters to 600 cubic centimeters, and more preferably ranges from 330 cubic centimeters to 510 cubic centimeters, even preferably 350 cubic centimeters to 465 cubic centimeters, and most preferably 385 cubic centimeters or 415 cubic centimeters.

The mass of the club head 42 preferably ranges from 165 grams to 225 grams, preferably ranges from 175 grams to 205 grams, and most preferably from 190 grams to 200 grams. Preferably, the face component 60 has a mass ranging from 50 grams to 110 grams, more preferably ranging from 65 grams to 95 grams, yet more preferably from 70 grams to 90 grams, and most preferably 78 grams. The aft-body 61 (without weighting) has a mass preferably ranging from 10 grams to 60 grams, more preferably from 15 grams to 50 grams, and most preferably 35 grams to 40 grams. The weighting members 122*a*, 122*b* and 122*c* have a combined mass preferably ranging from 30 grams to 120 grams, more preferably from 50 grams to 80 grams, and most preferably 60 grams. The interior hosel 54 preferably a mass preferably ranging from 3 grams to 20 grams, more preferably from 5 grams to 15 grams, and most preferably 12 grams. Additionally, epoxy, or other like flowable materials, in an amount ranging from 0.5 grams to 5 grams, may be injected into the hollow interior 46 of the golf club head 42 for selective weighting thereof.

Figure 5:
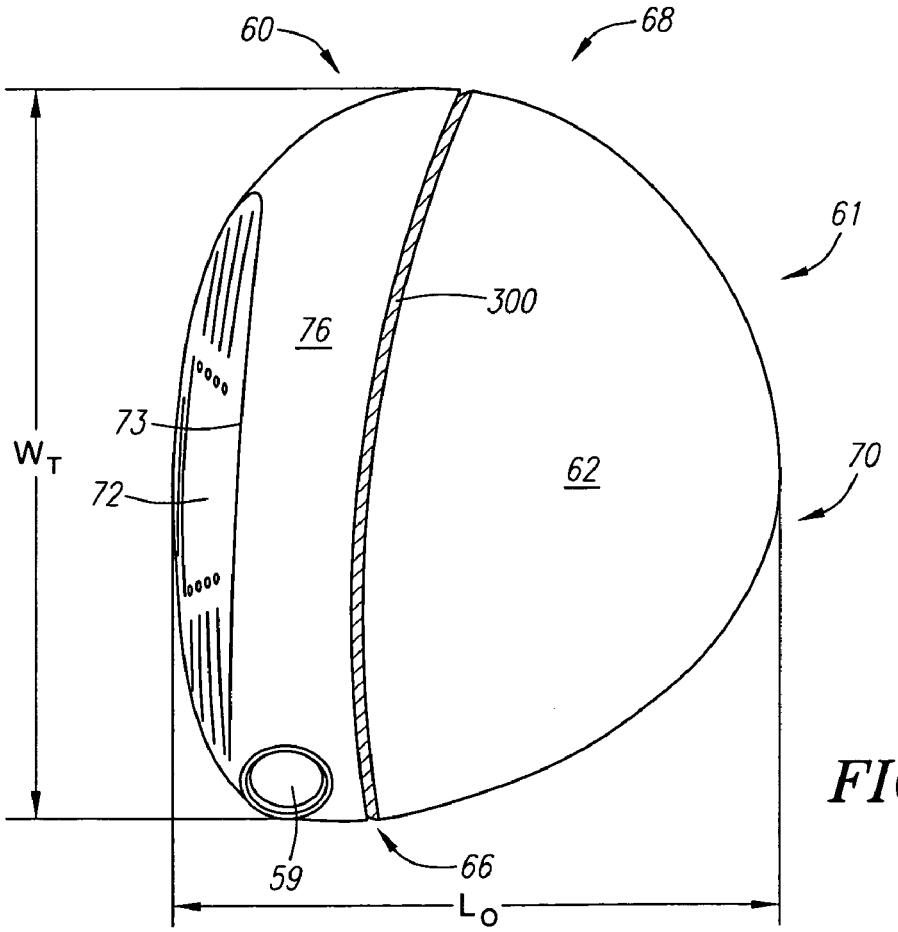
FIG. 5 is a top plan view of the golf club head of FIG. 2.
Figure 6:
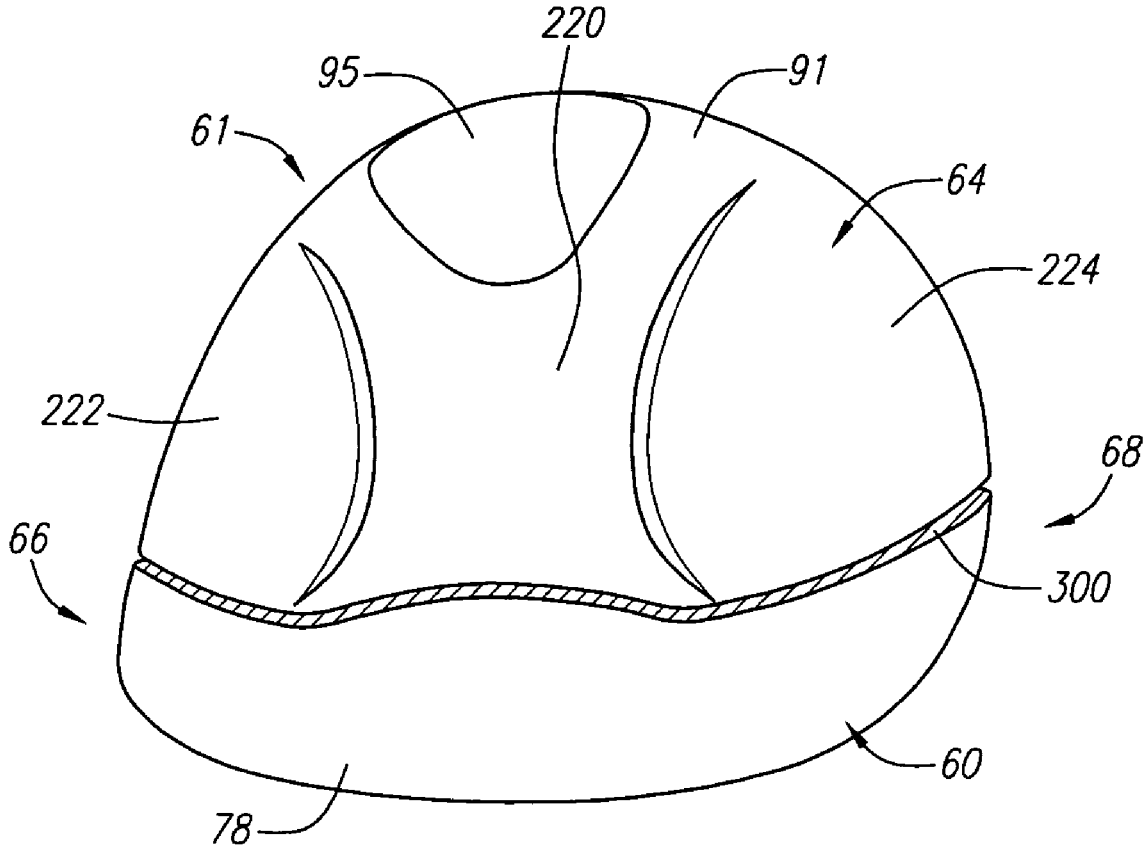
FIG. 6 is a bottom view of the golf club head of FIG. 2.
Figure 7:
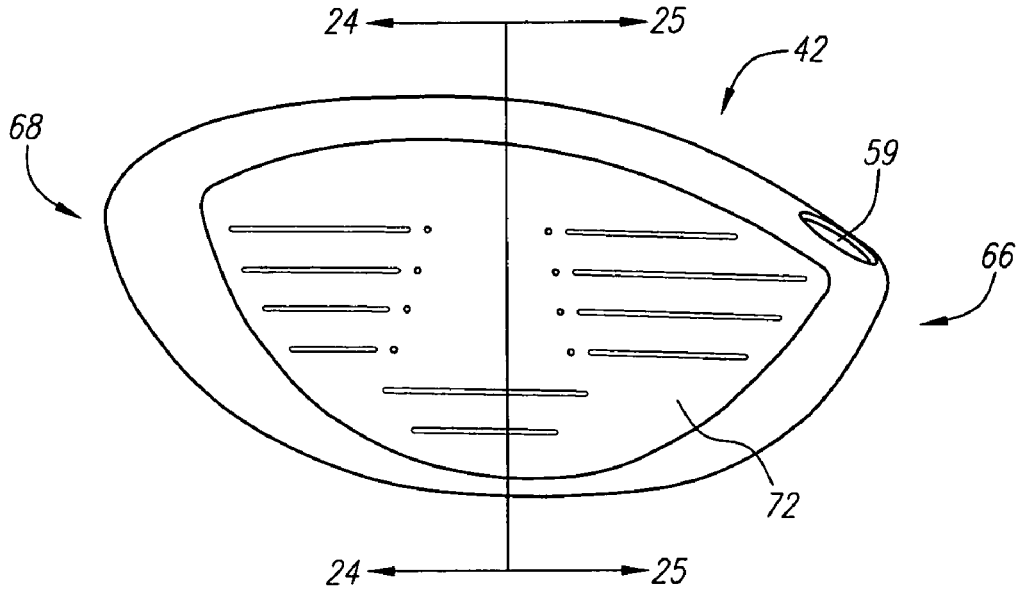
FIG. 7 is a front view of the golf club head.
Figure 8:
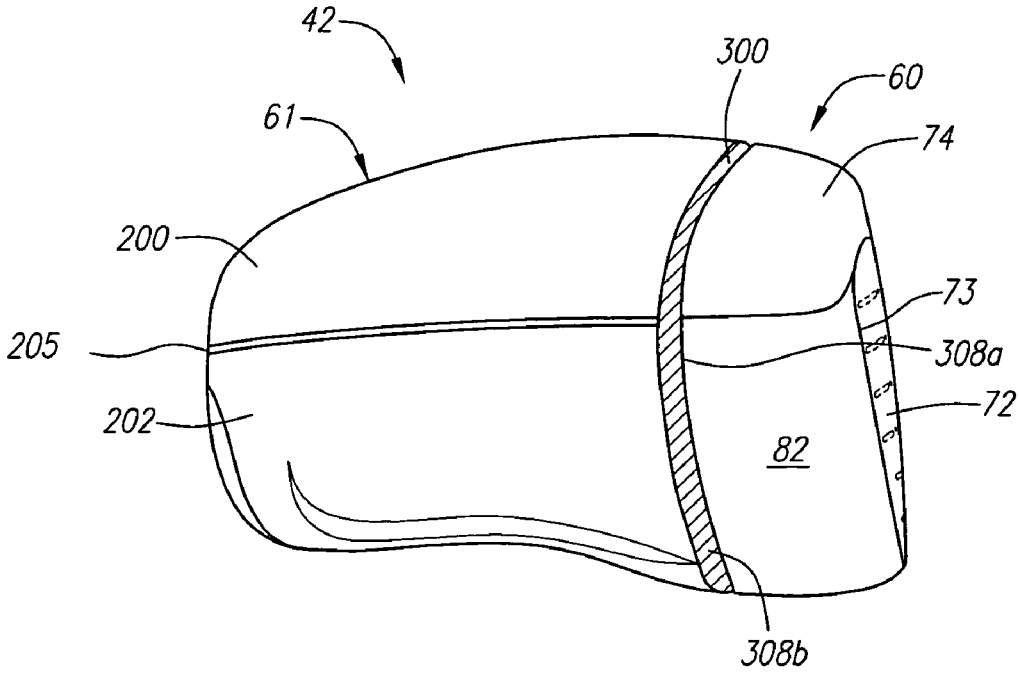
FIG. 8 is a toe side view of the golf club head of FIG. 2.
Figure 12:
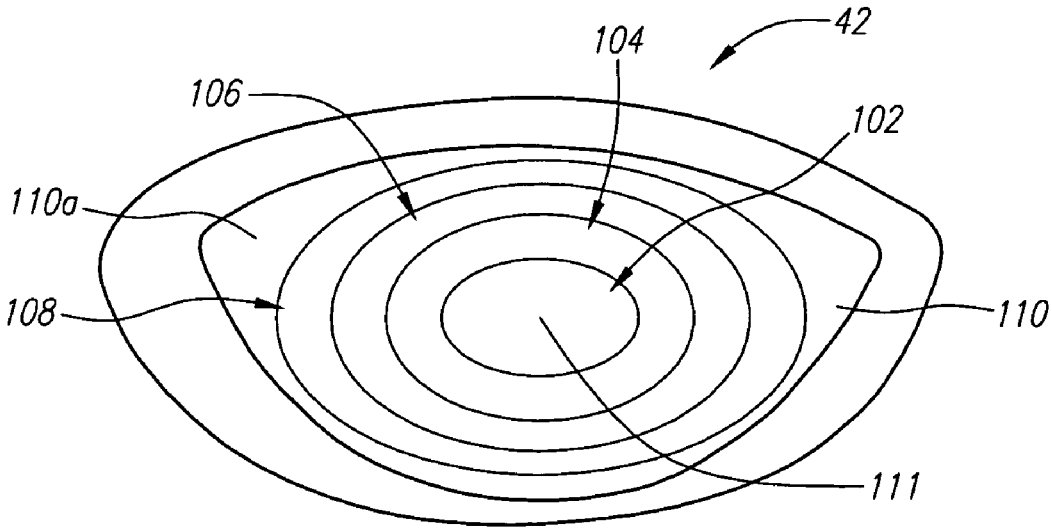
FIG. 12 is a front view of a golf club head illustrating regions of thickness.

As shown in FIG. 5, the length, "Lg", of the club head 42 from the striking plate portion 72 to the rear section of the crown portion 62 preferably ranges from 3.0 inches to 4.5 inches, and is most preferably 3.5 inches. As shown in FIG. 12, the height, "Hg", of the club head 42, as measured while in striking position, preferably ranges from 2.0 inches to 3.5 inches, and is most preferably 2.50 inches. As shown in FIG. 5, the width, "Wg", of the club head 42 from the toe section 68 to the heel section 66 preferably ranges from 4.0 inches to 5.0 inches, and more preferably 4.4 inches.

Figure 9:
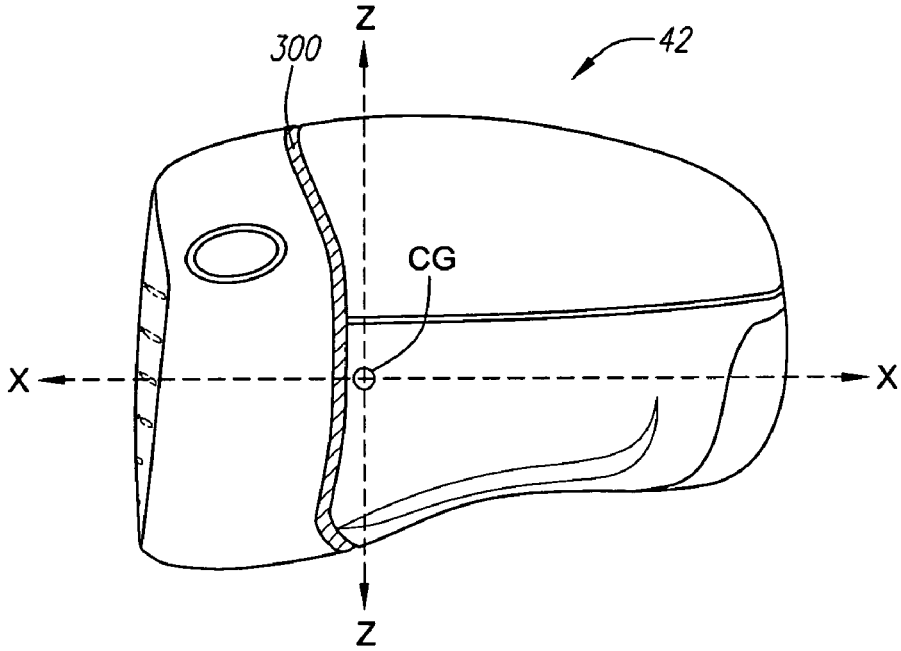
FIG. 9 is a heel side plan view of a golf club head illustrating the Z axis and X axis through the center of gravity.
Figure 10:
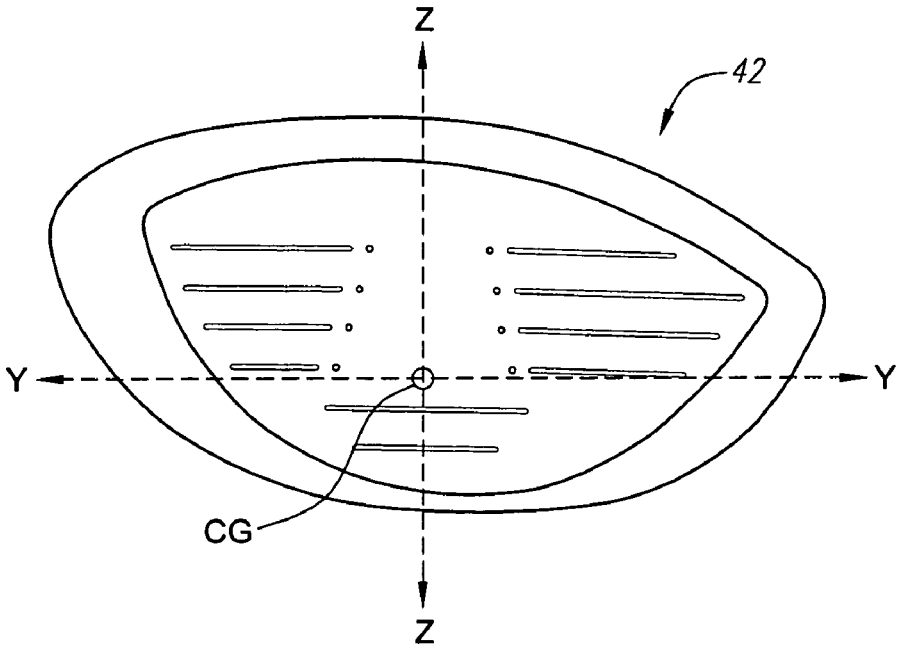
FIG. 10 is a front plan view of a golf club head illustrating the Z axis and Y axis through the center of gravity.
Figure 11:
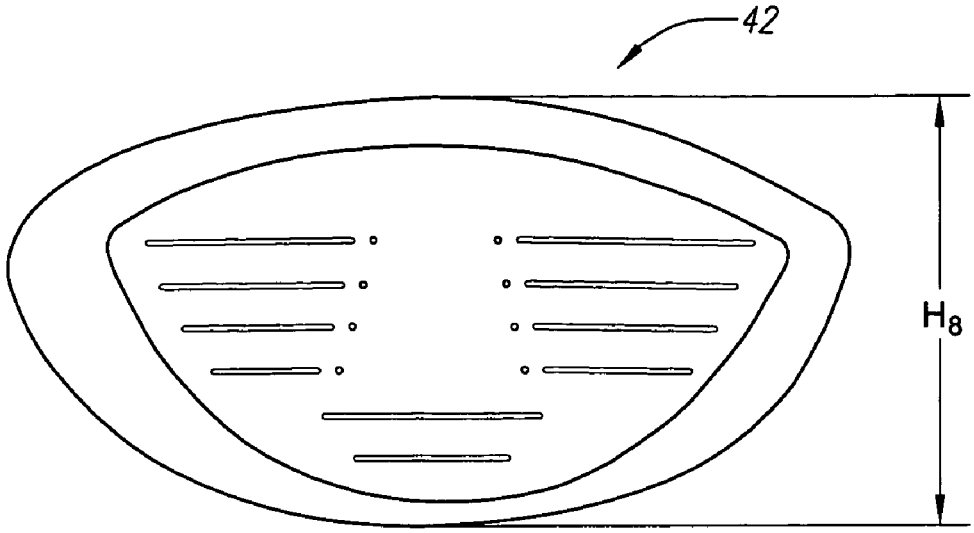
FIG. 11 is a front view of a golf club head.

FIGS. 9 and 10 illustrate the axes of inertia through the center of gravity of the golf club head. The axes of inertia are designated X, Y and Z. The X axis extends from the striking plate portion 72 through the center of gravity, CG, and to the rear of the golf club head 42. The Y axis extends from the toe section 68 of the golf club head 42 through the center of gravity, CG, and to the heel section 66 of the golf club head 42. The Z axis extends from the crown portion 62 through the center of gravity, CG, and to the sole portion 64.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity of a golf club head may be obtained using a center of gravity table having two weight scales thereon, as disclosed in U.S. Pat. No. 6,607,452, entitled High Moment Of Inertia Composite Golf Club, owned by Callaway Golf Company, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 42 preferably ranges from 2800 g-cm$^2$ to 5000 g-cm$^2$, preferably from 3000 g-cm$^2$ to 4500 g-cm$^2$, and most preferably from 3750 g-cm$^2$ to 4250 g-cm$^2$. The moment of inertia, Iyy, about the Y axis for the golf club head 42 preferably ranges from 1500 g-cm$^2$ to 2750 g-cm$^2$, preferably from 2000 g-cm$^2$ to 2400 g-cm$^2$, and most preferably from 2100 g-cm$^2$ to 2300 g-cm$^2$. The moment of inertia, Ixx, about the X axis for the golf club head 42 preferably ranges from 1500 g-cm$^2$ to 4000 g-cm$^2$, preferably from 2000 g-cm$^2$ to 3500 g-cm$^2$, and most preferably from 2500 g-cm$^2$ to 3000 g-cm$^2$.

In general, the golf club head 42 has products of inertia such as disclosed in U.S. Pat. No. 6,425,832, and is hereby incorporated by reference in its entirety. Preferably, each of the products of inertia, lxy, lxz and lyz, of the golf club head 42 have an absolute value less than 100 grams-centimeter squared. Alternatively, the golf club head 42 has a at least one or two products of inertia, Ixy, lxz and lyz, with an absolute value less than 100 grams-centimeter squared.

The gasket (300) may be utilized with a golf club head such as described in U.S. Pat. No. 6,582,323, for a Multiple Material Golf Club Head, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:

a face component composed of a metal material, the face component having a striking portion and a return portion;

an aft body having a crown and sole portion, the aft body attached to the return portion of the face component, the aft body composed of a metal material selected from the group consisting of magnesium alloys, aluminum alloys, magnesium, and aluminum; and a gasket positioned in a gap between the face component and the aft-body, wherein the gasket is composed of a polymer material.

2. The golf club head according to claim 1 wherein the gasket is composed of a thermoplastic polyurethane elastomer material.

3. The golf club head according to claim 1 wherein the gasket has a width in the range of 0.010 inch to 0.200 inch.

4. The golf club head according to claim 1 wherein at least a portion of the gasket has a "L" shaped cross-section.

5. The golf club head according to claim 1 wherein at least a portion of the gasket has a wedged shaped cross-section.

6. The golf club head according to claim 1 wherein at least a portion of the gasket has a rectangular shaped cross-section.

7. The golf club head according to claim 1 wherein at least a portion of the gasket has a circular shaped cross-section.

8. The golf club head according to claim 1 wherein the gap is positioned 0.5 inch to 2.5 inches from a perimeter of the striking plate of the face component.

9. A golf club head comprising:

a face component composed of a metal material, the face component having striking plate portion and a return portion, the striking plate portion having a thickness in the range of 0.010 inch to 0.250 inch and the return portion having a thickness ranging from 0.010 inch to 0.250 inch;

an aft body comprising an upper section and a lower section, the upper section comprising a crown portion and an upper ribbon portion and the lower section comprising a sole portion and a lower ribbon portion, the aft-body composed of a metal material selected from the group consisting of magnesium alloys, aluminum alloys, magnesium and aluminum, the aft-body attached to the return portion of the face component, the aft body having a thickness ranging from 0.015 inch to 0.100 inch; and a gasket positioned in a gap between the face component and the aft-body;

wherein the moment of inertia about the Izz axis through the center of gravity is greater than 3000 grams-centimeter squared, and the moment of inertia about the Iyy axis through the center of gravity is greater than 1900 grams-centimeter squared.

10. The golf club head according to claim 9 wherein the gasket is composed of a thermoplastic polyurethane elastoiner material.

11. The golf club head according to claim 9 wherein the gasket has a thickness in the range of 0.010 inch to 0.200 inch.

12. A golf club head comprising:

a face component composed of a metal material, the face component having striking plate portion and a return portion, the striking plate portion having a thickness in the range of 0.010 inch to 0.250 inch;

an aft body comprising an upper section and a lower section, the upper section comprising a crown portion and an upper ribbon portion and the lower section comprising a sole portion and a lower ribbon portion, the aft-body composed of a metal material selected from the group consisting of magnesium alloys, aluminum alloys, magnesium and aluminum, the aft-body attached to the return portion of the face component, the aft body having a thickness ranging from 0.015 inch to 0.100 inch;

a gasket positioned in a gap between the face component and the aft-body, wherein the golf club head has a volume ranging from 350 cubic centimeters to 525 cubic centimeters and a mass ranging from 175 grams to 225 grams.

* * * * *